US011355873B2

(12) United States Patent
Guillot et al.

(10) Patent No.: US 11,355,873 B2
(45) Date of Patent: Jun. 7, 2022

(54) ELECTRONIC DEVICE COMPRISING ELASTIC CONNECTION PINS

(71) Applicant: SAFRAN ELECTRONICS & DEFENSE, Paris (FR)

(72) Inventors: François Guillot, Paris (FR); Pascal Spoor, Paris (FR); Olivier Roche, Paris (FR)

(73) Assignee: SAFRAN ELECTRONICS & DEFENSE, Boulogne-Billancourt (FR)

( * ) Notice: Subject to any disclaimer, the term of this patent is extended or adjusted under 35 U.S.C. 154(b) by 0 days.

(21) Appl. No.: 17/275,898

(22) PCT Filed: Sep. 13, 2019

(86) PCT No.: PCT/EP2019/074589
§ 371 (c)(1),
(2) Date: Mar. 12, 2021

(87) PCT Pub. No.: WO2020/053437
PCT Pub. Date: Mar. 19, 2020

(65) Prior Publication Data

US 2021/0265752 A1 Aug. 26, 2021

(30) Foreign Application Priority Data

Sep. 14, 2018 (FR) ..... 18 58314

(51) Int. Cl.

| | |
|---|---|
| ***H01R 12/71*** | (2011.01) |
| ***H01R 12/75*** | (2011.01) |
| ***H01R 13/03*** | (2006.01) |
| ***H01R 13/6473*** | (2011.01) |

(52) U.S. Cl.
CPC ..... *H01R 12/712* (2013.01); *H01R 12/75* (2013.01); *H01R 13/03* (2013.01); *H01R 13/6473* (2013.01)

(58) Field of Classification Search
CPC .. H01R 12/00; H01R 12/585; H01R 12/7082; H01R 12/712; H01R 12/75; H01R 13/03; H01R 13/6473; H05K 3/308
See application file for complete search history.

(56) References Cited

U.S. PATENT DOCUMENTS 3,028,573 A * 4/1962 Stoehr ..... H05K 1/0289 439/48
4,415,220 A * 11/1983 Kant ..... H01R 12/585 439/751
5,456,608 A * 10/1995 Rogers ..... H01R 29/00 29/845

(Continued)

FOREIGN PATENT DOCUMENTS

DE 19831394 A1 3/2000
EP 0332720 A1 9/1989

*Primary Examiner* — Oscar C Jimenez
(74) *Attorney, Agent, or Firm* — Muncy, Geissler, Olds & Lowe, P.C.

(57) ABSTRACT

An electrical connector pin comprising a link segment for linking to the connector and an end segment that is free, the end segment having a cross-section that presents at least one curved portion curved about an axis parallel to a longitudinal direction of the end segment and the end segment having side edges forming electrical contact portions that can be moved towards each other causing the curved portion to deform elastically.

13 Claims, 2 Drawing Sheets

(56) References Cited

U.S. PATENT DOCUMENTS

| | | | | |
|---|---|---|---|---|
| 6,984,135 | B2 * | 1/2006 | Kaneko | H01R 12/585 439/82 |
| 9,136,624 | B1 | 9/2015 | Reynov et al. | |
| 9,812,799 | B2 * | 11/2017 | Wittig | H01R 13/502 |
| 10,312,609 | B2 * | 6/2019 | Kawate | H01R 12/596 |
| 10,714,849 | B2 * | 7/2020 | Mukoyama | H01R 12/737 |
| 2002/0195271 | A1 * | 12/2002 | Gailus | H01R 12/523 174/262 |
| 2012/0236523 | A1 * | 9/2012 | Yasuo | H05K 3/308 361/760 |

* cited by examiner

ELECTRONIC DEVICE COMPRISING ELASTIC CONNECTION PINS

The present invention relates to the field of electronics, and more particularly to the field of making electrical connections in electronic devices.

TECHNOLOGICAL BACKGROUND

It is known that an electronic device or component can be connected to a printed circuit board (PCB) by using a connector having pins for engaging in holes that have been provided in the printed circuit board and that possess inside surfaces covered in an electrically conductive coating and connected to conductor tracks of the printed circuit. These are referred to as plated holes or vias.

A pin is generally made of conductive metal and includes an end segment that is elastically deformable in a direction that is transverse relative to a longitudinal direction of the pin so that the end segment has two outside surface portions that are diametrically opposite each other and suitable for being moved elastically towards each other. The end segment can thus be engaged by force in the plated hole and its elasticity serves to provide permanent contact between the conductive coating of the plated hole and the outside surface portions of the end segment of the pin.

Several shapes of pin are known. By way of example, the most common in ordinary applications are split pins of round section or so-called "banana" pins.

Those pins are not suitable for use in applications in which the pins are highly stressed (mechanical, vibratory, thermal, . . . , stresses) and in particular in aviation where resistance to such stresses is the subject of standards such as the ARINC 600 standard.

For such applications, it is known to use connectors of the press-fit type having pins in which the end segment is in the shape of the "eye" of a needle, i.e. between a proximal solid portion and a distal solid portion, the end segment has an intermediate portion comprising two outwardly arcuate blades so as to have outside surface portions that are spaced apart from each other by a distance that is greater than the greatest transverse direction of the remainder of the end segment. The blades have first converging ends that are connected to the proximal solid portion and second converging ends that are connected to the distal solid portion, with the outside surface portions that provide contact with the plated hole being located on curved intermediate portions of the blades.

A drawback with that type of pin, is that it can be found to be relatively expensive to manufacture when it is to provide a connection that is reliable under certain conditions of use.

Another drawback of that type of pin is that the plated hole needs to be of length that is sufficient to receive the distal portion and the intermediate portion of the end segment of the pin while ensuring that the outside surface portions in contact with the electrically conductive coating of the plated hole are engaged far enough inside the plated hole to avoid any risk of becoming extracted therefrom under the effect of stresses applied to the connector and/or to the printed circuit board. Thus, it is considered that the points of contact between the outside surface portions of the pin and the electrically conductive coating of the plated hole need to be at a minimum depth of 0.3 millimeters (mm) relative to the inlet of the plated hole.

Also, with a high-frequency electronic device, the pins of present-day connectors give rise to an iterative impedance discontinuity in a matched line (and thus to iterative impedance), known as the "stub effect".

OBJECT OF THE INVENTION

An object of the invention is to provide an electrical connector pin that provides a reliable connection.

BRIEF SUMMARY OF THE INVENTION

To this end, the invention provides a high-frequency electronic device comprising: a printed circuit board having conductive tracks and at least a first series of blind holes that extend from a first face of the board and each of which is provided with an electrically conductive coating connected to at least one of the conductive tracks; and at least one connector that extends beside the first face and comprises a base and pins, each pin having a link segment that is linked to the base and an end segment that is free. The end segment has a cross-section presenting at least one curved portion that is curved around an axis parallel to a longitudinal direction of the end segment and the end segment having side edges that are provided with electrical contact portions and that can be moved towards each other by causing the curved portion to deform elastically, each of the end segments of the pins being received in a respective hole of the first series of blind holes, and the curved portion being deformed elastically in such a manner that the contact portions are pressed elastically against the electrically conductive coating.

The pins are relatively simple in structure, and the pressure exerted by the contact portions on the surface of the coating of the hole for receiving the pin can be adjusted by acting on the curvature of the curved portion, on the thickness of the end segment, and/or on the choice of material. This shape enables the pin to be sufficiently stiff while it is being inserted into the hole and also in use once it is connected, while also providing electrical contact that is reliable. This structure also makes it possible to have an end segment that is relatively short, suitable for being received in holes that are blind, and more generally in holes of relatively short length (in particular when compared with present-day solutions of the "press-fit" type). In the high-frequency electronic device, stub effects are limited.

According to a particular characteristic, each of the blind holes connects together two conductive tracks forming a differential line.

Advantageously, the cross-section includes two curved portions curved around respective axes parallel to the longitudinal direction of the end segment, the two portions being curved in mutually opposite directions, the cross-section preferably being substantially in the form of a flattened S-shape Optionally, the end segment includes a terminal portion that is chamfered and/or rounded.

In a preferred embodiment, the board includes a second series of blind holes extending facing the first series of blind holes.

According to characteristics that are optional:

- the ends of facing blind holes are spaced apart from each other by a distance lying in the range about 0.1 mm to 0.4 mm;
- the end segments of the pins are pushed into the holes over a length lying in the range 0.3 mm to 1.4 mm, preferably about 0.85 mm;
- the blind holes have a length lying in the range 1.4 mm to 1.6 mm; and the holes of each series are spaced apart by a distance of about 2.54 mm.

Other characteristics and advantages of the invention appear on reading the following description of a particular and nonlimiting embodiment of the invention.

BRIEF DESCRIPTION OF THE DRAWINGS

Reference is made to the accompanying drawings, in which.

DETAILED DESCRIPTION OF THE INVENTION

Figure 1:
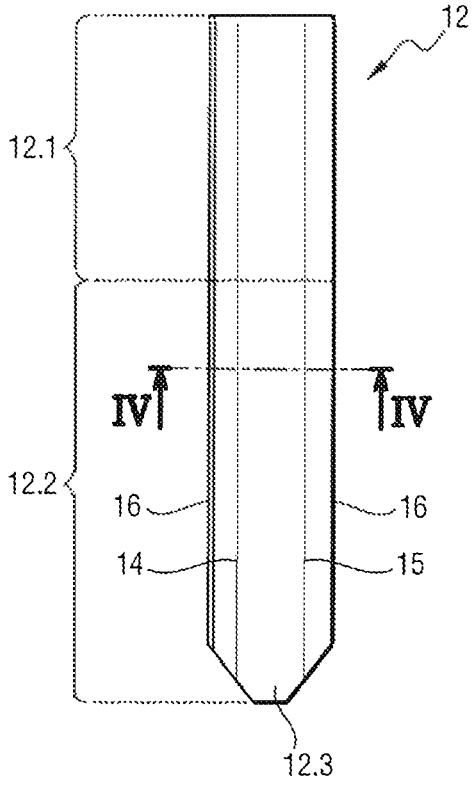
FIG. 1 is an elevation view of a pin of the invention.
Figure 2:
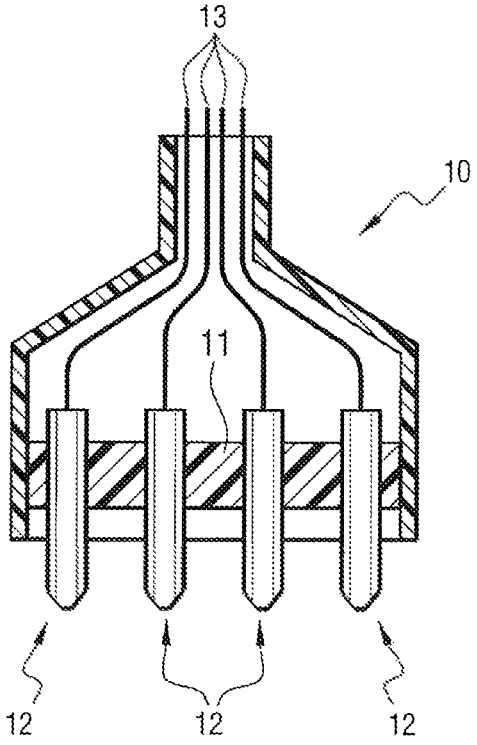
FIG. 2 is a section view of a connector of the invention.
Figure 3:
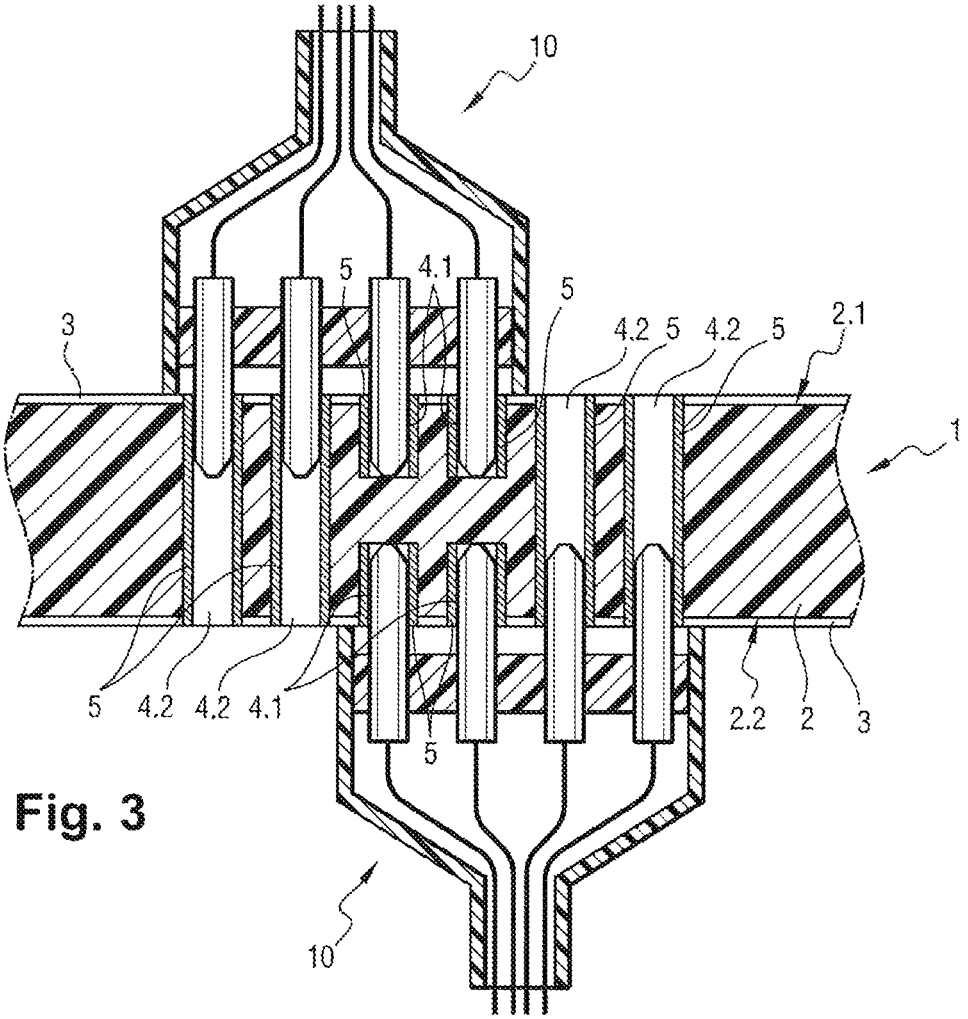
FIG. 3 is a fragmentary cross-section view of an electronic device of the invention.
Figure 4:
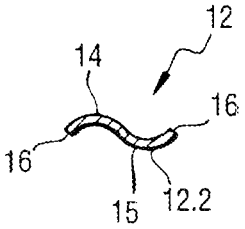
FIG. 4 is a view of the pin of the invention in cross-section on line IV-IV in FIG. 1.

With reference to FIGS. 1 to 4, the invention is described by way of example in application to an electronic device including a printed circuit board (PCB) given overall reference 1, which PCB comprises an electrically insulating substrate 2 that carries electrically conductive tracks 3 and that is provided with holes 4.1, 4.2, each of which is covered by an internal coating 5 that is connected to an electrically conductive track 3. The conductive tracks 3 are connected to high-frequency electronic components (not shown) and they form a high-frequency circuit.

The holes include a first series of blind holes 4.1 and a second series of blind holes 4.1 that extend facing each other from opposite faces 2.1 and 2.2 of the substrate 2. The blind holes 4.1 of each facing pair of holes lie on the same axis, and their ends are spaced apart by a distance of about 0.4 mm. Each of the blind holes 4.1 connects together two conductive tracks forming a differential line.

The holes include other holes 4.2 that are through holes opening out into both of the faces 2.1 and 2.2.

In this example, the substrate has a thickness of 3.2 mm and the holes 4.1 have a depth of about 1.4 mm. In each series, the holes 4.1 and 4.2 are spaced apart from one another by a distance of about 2.54 mm.

The device includes connectors 10, each comprising a base 11 having pins fastened thereto, the pins being given overall reference 12.

Each pin 12 possesses:

- a link segment 12.1 fastened to the base 11 and connected to an electric cable 13; and
- an end segment 12.2 extending the link segment 12.1 and having a free terminal portion 12.3.

The link segments 12.1 are fastened to the base 11 in conventional manner, e.g. by overmolding. Each link segment 12.1 is electrically connected to an electric cable 13 in conventional manner, e.g. by soldering.

In this example, the link segment 12.1 and the end segment 12.2 are made out of a single piece of metal. In this example, the metal used is one of the following alloys: CuSn4, CuSn6, CuNiSi, CuCrAgFeTiSi. Each pin 12 is manufactured by being cut out from a sheet of the specified metal. Provision is made for surface treatment by depositing a layer of nickel having a thickness of about 1.5 micrometers (μm) with a so-called "flash" nickel finish over a thickness of about 0.3 μm to 1.0 μm. It is naturally possible to envisage using other electrically conductive materials, and in particular metals and alloys.

The pin 12 is of flat elongate shape. The term "flat" is used to mean that the pin 12 presents thickness that is smaller than its width measured perpendicularly to its longitudinal direction.

The end segment 12.2 of the pin 12 is made from a blade of cross-section that is initially rectangular and that has been deformed in this example to end up presenting an undulating shape.

The cross-section presents two curved portions 14 and 15 that are curved about respective axes parallel to the longitudinal direction of the end segment 12.2. The two curved portions 14 and 15 are curved in mutually opposite directions, and the cross-section is substantially in the form of a flat S-shape.

The end segment 12.2 thus has side edges that form electrical contact portions that can be moved towards each other, giving rise to elastic deformation of the curved portions 14 and 15.

The end segment has a terminal portion 12.3 that is chamfered in this example. In a variant, the terminal portion 12.3 is rounded.

The connectors are mounted on the electronic card 1 by engaging the end segments 12.2 in the holes 4.1, 4.2. Doing this causes the end segments 12.2 to be deformed transversely, thereby moving the side edges 16 towards each other. This deformation gives rise to increased curvature of the curved portions 14 and 15. This deformation takes place progressively because of the shape of the terminal portion 15.3, with the chamfers also assisting in centering the pin in the hole. It should be observed that the force needed for deforming the curved portions 14 and 15 depends in particular on the thickness of the blade forming the end portion 12.2 and on the initial curvature of the curved portions 14 and 15. Thus, said thickness and the initial curvature should be determined as a function of the desired insertion force and of the pressure with which the side edges 16 are to press against the internal coating 5. The end segments of the pins are pushed into the holes over a length lying in the range 0.3 mm to 1.4 mm and preferably about 0.85 mm.

Once the connectors are mounted on the electronic card 1, the end segments 12.2 of the pins 12 are each received in a respective hole 4.1 or 4.2 and they remain elastically deformed transversely so that their side edges 16 are pressed elastically along their entire length against the electrically conductive coating 5. The fact that the side edges 16 of the end segment are in contact with the internal coating of the hole along their entire length limits the risk of any excessively localized stress concentration that might lead to the coating being deteriorated.

It should be observed that the undulating shape of the cross-section of the end segment imparts stiffness thereto and relatively good resistance to buckling, thereby facilitating the operation of inserting the end segment in the hole.

It should also be observed that using blind holes 4.1 and relatively short pins 12 serves to maximize high-frequency passbands by minimizing the "stub" effect of the plated holes on matched lines at high frequencies.

Figure 5:
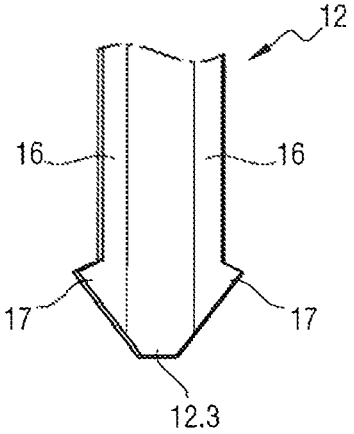
FIG. 5 is a fragmentary view analogous to FIG. 1 showing a pin in a variant embodiment.

With reference to FIG. 5, each of the side edges 16 is provided with a contact portion 17 projecting from the remainder of the side edge in question. In this example, the contact portions 17 are triangular in shape and they are situated on the terminal portion 12.3, with the chamfers extending front surfaces of the contact portions.

Naturally, the invention is not limited to the embodiment described and covers any variant coming within the ambit of the invention as defined by the claims.

In particular, the electronic device may be of any structure, and in particular: it may have a number of holes that is different from that shown, its holes may be blind or through only, only without facing holes, with a multi-layer PCB or a single-layer PCB. The substrate may be of a different thickness and the holes may be of a different depth.

Any technology may be used for mounting components on the printed circuit board.

The connector may be of a structure different from that described. The connector may optionally comply with the ARNIC 600 standard, it may be a series connector or a parallel connector, or in general manner it may be any connector having pins . . . .

The pins may be of a structure different from that described, and in particular:

- the link segment may be of any section (e.g. not flat) providing its section gives it sufficient stiffness (resistance to buckling) to enable the end segment to be engaged in the plated hole, and for example it may be tubular, circular, square;
- the end segment may have edges that are plane or that are rounded (about axes parallel to the longitudinal direction of the end segment);
- the end segment may have an end that is pointed in order to facilitate inserting it in a hole.

Nevertheless, it is preferable to have an end that is chamfered (having the shape of a tapering tip) as shown in figures, since then the centering function does not give rise to any significant increase in the length of the end segment;

- the side edges may include projecting contact portions, and the shape of these contact portions may be triangular or rounded (circular or elliptical) or some other shape;
- It is possible to act on the slope of the rear surfaces of the contact portions 17 so as to enable the pin to be removed by an operator;
- the contact portions may be rounded in shape (circular or elliptical), or they may be of some other shape;
- the contact portions may extend over all or part of the length of the end segment;
- the contact portions may optionally be arranged to penetrate locally into the electrically conductive coating of the hole in which the pin is received, so each contact portion may thus include a projecting tooth to bite into the coating and improve retention of the end segment in the hole;
- the end segment may be attached to the link segment, in particular by welding or soldering; and
- the cross-section of the end segment may present one or more curved portions.

The invention claimed is:

1. A high-frequency electronic device comprising: a printed circuit board having conductive tracks and at least a first series of blind holes that extend from a first face of the board and each of which is provided with an electrically conductive coating connected to at least one of the conductive tracks; and at least one connector that extends beside the first face and comprises a base and pins, each pin having a link segment that is linked to the base and an end segment that is free, the end segment having a cross-section presenting at least one curved portion that is curved around an axis parallel to a longitudinal direction of the end segment and the end segment having side edges that are provided with electrical contact portions and that can be moved towards each other by causing the curved portion to deform elastically, each of the end segments of the pins being received in a respective hole of the first series of blind holes, and the curved portion being deformed elastically in such a manner that the contact portions are pressed elastically against the electrically conductive coating, wherein the board includes a second series of blind holes extending facing the first series of blind holes.

2. The device according to claim 1, wherein each of the blind holes connects together two conductive tracks forming a differential line.

3. The device according to claim 1, wherein the cross-section includes two curved portions curved around respective axes parallel to the longitudinal direction of the end segment, the two portions being curved in mutually opposite directions.

4. The device according to claim 3, wherein the cross-section is substantially in the form of a flattened S-shape.

5. The device according to claim 1, wherein the end segment includes a terminal portion that is chamfered and/or rounded.

6. The device according to claim 1, wherein the ends of the facing blind holes are spaced apart from each other by a distance of about 0.2 mm.

7. The device according to claim 1, wherein the end segments of the pins are pushed into the holes over a length lying in the range 0.3 mm to 1.4 mm.

8. The device according to claim 7, wherein the end segments of the pins are pushed into the holes over a length of about 0.85 mm.

9. The device according to claim 1, wherein the blind holes have a length lying in the range 1.4 mm to 1.6 mm.

10. The device according to claim 1, wherein the holes of each series are spaced apart by a distance of about 2.54 mm.

11. A high-frequency electronic device comprising: a printed circuit board having conductive tracks and at least a first series of blind holes that extend from a first face of the board and each of which is provided with an electrically conductive coating connected to at least one of the conductive tracks; and at least one connector that extends beside the first face and comprises a base and pins, each pin having a link segment that is linked to the base and an end segment that is free, the end segment having a cross-section presenting at least one curved portion that is curved around an axis parallel to a longitudinal direction of the end segment and the end segment having side edges that are straight and provided with electrical contact portions and that can be moved towards each other by causing the curved portion to deform elastically, each of the end segments of the pins being received in a respective hole of the first series of blind holes, and the curved portion being deformed elastically in such a manner that the contact portions are pressed elastically against the electrically conductive coating, the cross-section being substantially in the form of a flattened S-shape and including two curved portions curved around respective axes parallel to the longitudinal direction of the end segment, the two portions being curved in mutually opposite directions, wherein the board includes a second series of blind holes extending facing the first series of blind holes.

12. A high-frequency electronic device comprising: a printed circuit board having conductive tracks and at least a first series of blind holes that extend from a first face of the board and a second series of blind holes extending facing the first series of blind holes, the holes of each series being spaced apart by a distance of about 2.54 mm and each hole having a length lying in the range 1.4 mm to 1.6 mm and being provided with an electrically conductive coating connecting together two conductive tracks forming a differential line; and at least one connector that extends beside the first face and comprises a base and pins, each pin having a link segment that is linked to the base and an end segment that is free, the end segment having a cross-section presenting at least one curved portion that is curved around an axis parallel to a longitudinal direction of the end segment and the end segment having side edges that are provided with electrical contact portions and that can be moved towards each other by causing the curved portion to deform elastically, each of the end segments of the pins being received in a respective hole of the first series of blind holes, and the curved portion being deformed elastically in such a manner that the contact portions are pressed elastically against the electrically conductive coating, wherein the ends of the facing blind holes are spaced apart from each other by a distance of about 0.2 mm and the end segments of the pins are pushed into the holes over a length lying in the range 0.3 mm to 1.4 mm.

13. A high-frequency electronic device comprising: a printed circuit board having conductive tracks and at least a first series of blind holes that extend from a first face of the board and each of which is provided with an electrically conductive coating connected to at least one of the conductive tracks; and at least one connector that extends beside the first face and comprises a base and pins, each pin having a link segment that is linked to the base and an end segment that is free, the end segment having a cross-section presenting at least one curved portion that is curved around an axis parallel to a longitudinal direction of the end segment and the end segment having side edges that are provided with electrical contact portions and that can be moved towards each other by causing the curved portion to deform elastically, each of the end segments of the pins being received in a respective hole of the first series of blind holes, and the curved portion being deformed elastically in such a manner that the contact portions are pressed elastically against the electrically conductive coating, the end segment of the pin is constituted of a flat blade of cross-section that is initially rectangular and that has been deformed to end up presenting the curved portion.

* * * * *